United States Patent [19]

Inamura et al.

[11] 3,974,306

[45] Aug. 10, 1976

[54] METHOD FOR COATING THE INNER SURFACE OF METAL PIPES

[75] Inventors: Keizo Inamura; Tadayoshi Tatsuno; Toshio Okoshi, all of Hiratsuka, Japan

[73] Assignee: Kansai Paint Company, Ltd., Japan

[22] Filed: Oct. 4, 1973

[21] Appl. No.: 403,394

[30] Foreign Application Priority Data

Oct. 6, 1972 Japan ..... 47-100947

[52] U.S. Cl. ..... 427/183; 118/306; 118/309; 118/317; 118/408; 118/DIG. 10; 427/181; 427/195; 427/231; 427/232; 427/233; 427/234; 427/238; 427/239; 427/318; 427/350

[51] Int. Cl.[2] ..... B05D 7/22; B05D 3/02

[58] Field of Search ..... 117/21, 18, 22, 23, 117/97, 119; 427/181, 182, 183, 195, 231, 232, 233, 234, 238, 239, 318, 350; 118/55, 306, 309, 317, 408, DIG. 10, DIG. 11

[56] References Cited

UNITED STATES PATENTS

| | | | |
|---|---|---|---|
| 3,074,808 | 1/1963 | Harrison | 117/18 X |
| 3,207,618 | 9/1965 | De Hart | 117/21 X |
| 3,484,276 | 12/1969 | Burggraaf et al. | 117/21 X |
| 3,814,616 | 6/1974 | Kondo et al. | 117/18 X |
| 3,850,660 | 11/1974 | Inamura et al. | 117/97 X |

FOREIGN PATENTS OR APPLICATIONS

| | | |
|---|---|---|
| 2,228,809 | 1/1973 | Germany |

*Primary Examiner*—Ronald H. Smith
*Assistant Examiner*—Shrive P. Beck
*Attorney, Agent, or Firm*—Larson, Taylor and Hinds

[57] ABSTRACT

A method for coating the inner surface of a metal pipe having an inner diameter of about 1 to 15 cm, which comprises feeding from one end of said metal pipe dry particles of a coating composition into the interior of the metal pipe preheated at a temperature of from a softening point of said coating composition to below a melting point thereof, sucking air at the same time from the other end of the metal pipe so as to form an air stream carrying the particles and flowing in the interior of the pipe at a flow rate of about 4 to 20 m/sec and to allow the particles to deposit on the inner surface of the pipe, and fusing the deposited particles at a reduced pressure of 10 to about 100 mm Hg to form a continuous film on the inner surface of the pipe.

6 Claims, 2 Drawing Figures

METHOD FOR COATING THE INNER SURFACE OF METAL PIPES

This invention relates to a method for coating the inner surface of a metal pipe, more particularly to a method for forming continuous film on the inner surface of a metal pipe having a relative small inner diameter by powder coating.

To protect a metal pipe from corrosion due to water, steam, chemicals, etc. flowing in the pipe, it is required to coat the inner surface of the pipe with a continuous resin film, and dry powder of coating compositions has been used for this purpose. In one of the known methods dry powder of a thermoplastic resin is fluidized in an air stream, in which a metal pipe preheated to a temperature higher than the melting point of the resin is immersed to form a resin film on the inner and outer surfaces of the pipe. According to this method, however, it is difficult to form a uniform pinhole-free coating on the inner surface of a pipe having an inner diameter smaller than about 15 cm, since resin particles can not be fluidized evenly in the interior of the pipe of such a small inner diameter. Further when a long pipe is treated in the above manner, it has to be dipped in a fluidized bed of resin particles on a large-scale apparatus, and it is impossible to fluidize the resin particles uniformly on the interior surface of the pipe in the lengthwise direction thereof, with the result that an uneven film having numerous pinholes is formed. Since not only the inner surface but also the outer surface of the pipe is coated simultaneously, this method has another disadvantage that it is practically impossible to provide the resin coating only on the interior surface of the pipe.

In U.S. pat. No. 3,207,618 there is disclosed that a resin film is formed on the inner surface of a metal pipe by sucking a dry powder coating composition with air stream through the interior of a metal pipe heated at a temperature higher than a melting point of the powder coating composition. However, this method is not suitable for coating the interior of a metal pipe of a small diameter, because the particles heated at a temperature higher than the melting point of the powder coating composition adhere to each other during the passage thereof through the interior of the pipe to produce greater particles resulting in the formation of an uneven resin film having pinholes. Further the particles adhering to each other render it difficult to reuse excessive powder coating composition recovered.

It is also known in the art to form a resin film on the inner surface of a pipe by electrostatic coating, using clear or pigmented dry powder of resins. This method employs an electrostatic powder spraying gun, so-called "Pole gun", which is provided with a slidably extendable barrel and the coating is conducted by inserting the barrel of the gun into the interior of a metal pipe electrically grounded, spraying charged particles through the barrel to electrostatically deposit them on the inner surface of the pipe, and heating the pipe to produce a continuous coating film. However, this method is not suitable for coating the interior of a metal pipe of a small inner diameter, because spark discharge frequently occurs between the high voltage electrode at the head of the gun barrel and the inner wall of the metal pipe, making it difficult to ensure uniform depositions of the charged particles. In fact, when a metal pipe having an inner diameter smaller than about 15 cm, particularly below about 10 cm, is coated by this method, the resultant coating film formed on the inner surface of the pipe is uneven in thickness and has numerous pinholes throughout the film.

One object of the invention is accordingly to provide a method for coating the interior of a metal pipe, which is capable of forming a uniform and continuous coating having excellent surface-smoothness free from pinholes on the inner surface of the pipe having such a small inner diameter as about 1 to 15 cm.

Another object of the invention is to provide a method for coating the inner surface of a metal pipe in a continuous manner regardless of the length of the pipe.

Another object of the invention is to provide a method for coating the inner surface of a metal pipe which makes it possible to recover an excessive power coating composition without particles adhering to each other.

These and other objects of the invention will be apparent from the following description.

The method of the invention to be applied in coating the inner surface of a metal pipe having such a small inner diameter as about 1 to 15 cm comprises feeding from one end of the metal pipe dry particles of a coating composition into the interior of the metal pipe preheated at a temperature of from a softening point of said coating composition to below a melting point thereof, sucking air at the same time from the other end of the metal pipe so as to form an air stream carrying the particles and flowing in the interior of the pipe at a rate of about 4 to 20 m/sec and to allow the particles to deposit on the inner surface of the pipe, and fusing the deposited particles at a reduced pressure of 10 to 100 mm Hg to form a continuous film on the inner surface of the pipe.

Throughout the specification and claims "softening point" means a value determined in accordance with ASTM D 1525–58T, and "melting point" means a value determined in accordance with ASTM D 1238–57T, using a load of 2160 g at a flow rate of 10± 1 g/10 min.

According to the present invention, uniform and continuous film coating free from pinhole can be produced on the inner surface of a metal pipe having such a small inner diameter that it has been difficult or impossible to form such a uniform pinhole-free film on the inner surface thereof by the conventional methods. In fact, the inner surface of a metal pipe having an inner diameter smaller than about 15 cm, particularly about 1 to 10 cm, can be effectively coated by the method of the invention. Moreover, the method of this invention makes it possible to form a continuous coating film having excellent surface-smoothness on the inner surface of a pipe not greater than about 15 cm in its inner diameter. Further in the method of the invention, the excessive powder coating compositions can be recovered and reused easily without particles adhering to each other, since the powder coating composition is heated at a temperature below a melting point thereof.

The metal pipe which can be coated by the invention includes those having an inner diameter of about 1 to 15 cm and made of steel, stainless-steel, aluminum, copper and like metals.

Various dry coating compositions heretofore used for coating may be employed in the invention. For example, polyvinylchloride, polyethylene, polypropylene, polyamide, polyester, chlorinated polyether, epoxy resin, phenol resin, polyvinylfluoride and like thermoplastic or thermosetting resins may be used as a coating composition in the invention in the form of dry powder, to which may be added, if necessary, plasticizers, stabilizers, coloring agents and like additives. Preferable particle size of the coating compositions is in the range of about several microns to 500 $\mu$.

According to the process of the present invention, a metal pipe to be coated is preferably positioned horizontally, though it may be positioned vertically or in any direction desired. From one end of the pipe dry powder of the coating composition is fed continuously into the interior of the pipe by a suitable dry coating machine. At the same time air is sucked from the other end of the pipe by a suitable sucking device, such as suction pump, suction fan, etc., whereby an air stream is produced in the interior of the pipe. The dry powder fed from one end, while being carried by such air stream, is deposited on the inner surface of the pipe, resulting in uniform deposition of the powder on the entire inner surface of the pipe. To ensure uniform deposition, it is essential that a metal pipe to be coated be preheated at a temperature of from a softening point of the powder coating composition to below a melting point thereof. When the metal pipe is preheated at a melting point or higher, particles of the powder coating composition fed into the interior of the metal pipe tend to adhere each other to produce greater particles resulting in the formation of uneven coating film. If the inner surfaces of the pipe is preheated at a temperature below a softening point of the powder coating composition, the particles deposited on the inner surface of a metal pipe are not adhered thereto with the result that they are again carried away by the air stream flowing in the interior of the pipe. The flow rate of the air stream flowing in the interior of the pipe is also important to ensure uniform deposition and is in the range of about 4 to 20 m/sec. If the flow rate is lower than about 4 m/sec, the powder is mainly deposited on a portion near the inlet of the pipe without uniform deposition being effected over the entire inner surface of the pipe, and at a higher flow rate of about 20 m/sec almost all powder particles are carried away with air and effective deposition can no longer be achieved. Particularly preferable flow rate is in the range of 7 to 13 m/sec.

To assure the deposition of the powder more uniformly it is preferable to rotate the metal pipe at least one r.p.m. during the coating. The preferable rotation rate may be about 5 to 50 r.p.m. though it may be increased to such a high rate as about 200 r.p.m.

The powder thus deposited on the inner surface of the pipe is then heated to fuse into a continuous coating film at a temperature lower than the decomposition temperature of the composition but higher than the melting point thereof. According to this invention, it is essential to fuse the composition especially at a reduced pressure of 10 to 100 mm Hg in terms of absolute pressure. The fusing conducted at the reduced pressure of 10 to 100 mm Hg achieves an outstanding effect of imparting remarkably improved surface-smoothness to the continuous coating film obtained. The continuous smooth coating formed on the inner surface of pipe reduces the resistance to fluids when the pipe is used for conveying water and other fluids, assuring a great advantage in the transportation of fluids. As the absolute pressure increases over 100 mm Hg or descreases below 10 mm Hg, the surface-smoothness tends to reduce. Preferable pressure is in the range of 30 to 80 mm Hg.

The interior pressure of the hollow metal pipe must be at a level of 10 to 100 mm Hg when the powder deposited on its inner surface is substantially fused, since when the pressure is reduced after the deposited powder has already started fusing, a smooth-surfaced continuous film will not be formed on the inner surface of the pipe. Accordingly, the interior pressure may be reduced to the above-mentioned level before or when the deposited powder reaches a temperature at which it starts of fuse. The reduced pressure in the interior of the pipe may be maintained during the heating or may be released after the deposited powder is fused to form a continuous film. The latter method is particularly affective to the powder coating composition having thermosetting property. For example, when the thermosetting powder coating composition is deposited on the inner surface of the metal pipe, it is preferable that the deposited powder be fused under the above specific reduced pressure and then further heated for curing after the pressure is released to atmospheric pressure.

The thickness of the film thus obtained may vary over a wide range in accordance with the kinds of the coating compositions used and the time for coating, but usually it is in the range of about 100 to 700 $\mu$.

For a better understanding of the invention, examples are given below in which the apparatus shown in the attached drawings is used.

Figure 1:
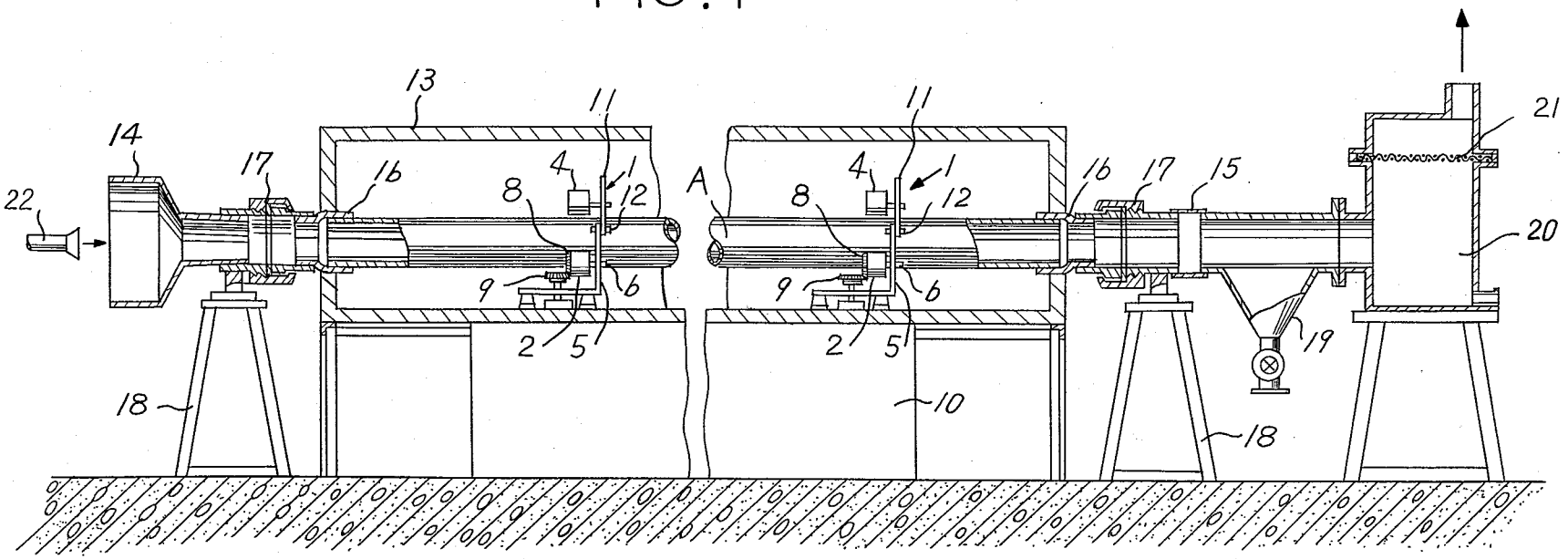
FIG. 1 shows a side view partially in section of one preferred apparatus for carrying out the method of the invention.
Figure 2:
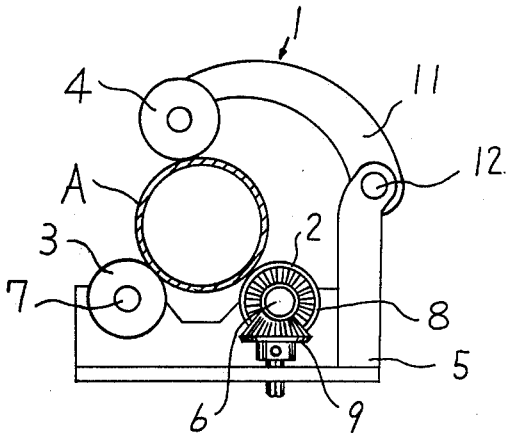
FIG. 2 is a front view of rotating means shown in FIG. 1.

Referring now to the drawings, designated at 1 is a couple of rotating means for a metal pipe to be coated, each of which comprises a driving roll 2, idle roll 3, set roll 4 and supporting means 5 for these rolls. The driving roll 2 and idle roll 3 are rotatably supported on shafts 6 and 7 on the supporting means 5, and the driving roll 2 is driven by bevel gears 8 and 9 which are driven through a reduction gear (not shown) by a motor (not shown), these reduction gear and motor being disposed in a case 10. The set roll 4 is rotatably supported on an arm 11 fixed to supporting means 5 with a screw 12.

A metal pipe A, the inner surface of which is to be coated, is mounted horizontally on the couple of rotating means 1 and held in position by the set roll 4 so as to be rotated by means of the driving roll 2. The metal pipe A is airtightly connected to a baffle 14 at the front end and to a rubber pipe 15 at the back end by means of socket and spigot joints 16 and union joints 17 respectively. Each union joint is supported by a frame 18. Designated at 13 is a heating furnace for the pipe A. The rubber pipe 15 is connected to a powder recovery hopper 19, and is further connected to air-sucking means (not shown) with a powder recovery box 20 disposed therebetween. The box is provided with a bag filter or screen 21 to prevent escape of the powder. Designated at 22 is a barrel head of a dry coating machine (not shown).

The pressure reducing means, although not shown, may usually be a vacuum pump. For instance, the coated hollow pipe is placed in an oven, and one end of the pipe is tightly closed with a heat-resistant rubber cork, with the other end connected to the suction opening of a vacuum pump.

EXAMPLE 1

The inner surface of a steel pipe, 5.5 m in length and 25 mm in inner diameter, was coated in the following manner on the apparatus shown in attached drawings, using a powder coating-composition below:

| | |
|---|---|
| Powder coating composition used: | |
| Components: | |
| Epoxy resin ("Epon 1004", trade mark, Shell Chemical Co., Ltd., Japan) | 100 wt. parts |
| Dicyanediamide (hardener) | 4 wt. parts |
| Titanium dioxide (pigment) | 50 wt. parts |
| Softening point: | 90°C |
| Melting point: | 100°C |
| Curing temperature: | 125°C |
| Particle size: | 20–150 μ |

The pipe mounted on the rotating means 1 was rotated at 5 r.p.m. and heated at a temperature of about 95°C. The above powder coating composition was blown through the flock spray-gun to the baffle 14 at the rate of 300 g/min. At the same time air was sucked by means of a suction pump, whereby air stream flowing through the interior of the pipe at a flow rate of 7 m/sec was produced. The dry powder blown was carried by the air stream and deposited on the inner surface of the pipe. This procedure was continued for 2 minutes.

Subsequently, the hollow steel pipe A with the coating composition deposited on its inner surface was tightly closed at its one end by silicon rubber cork and connected at the other end thereof to a suction opening of a vacuum pump by way of a manometer. While maintaining the interior of the steel pipe A at a reduced pressure of 50 mm Hg, the pipe A was heated in an oven to 110°C for about 10 minutes and then the interior pressure of the steel pipe A was returned to the atmospheric pressure, followed by further heating to 180°C. The heating at that temperature was continued for 30 minutes to cure the epoxy resin. As a result, a hollow steel pipe was obtained which was coated on its interior surface with a film of the epoxy resin having an almost uniform thickness of about 230 μ. When the coated surface of the steel pipe was subjected to discharge at a voltage of 1500 V in contact with a pinhole tester (trade mark: "Poroscope H 2e", product of HELMUT FISCHER G.m.b.H., West Germany), no spark was observed to take place. Thus it was ascertained that the coating film on the inner surface of the hollow steel pipe was free of any pinhole. Further when the coated steel pipe was immersed in a 5 wt.% aqueous solution of sodium chloride at 20°C, no rust was produced even after 1,000 hours immersion. When the surface-smoothness of the coating film was measured by roughness meter, the film was found very smooth.

EXAMPLE 2

Coating was conducted in the same manner as in Example 1, except that the flow rate of the air stream was 10 m/sec. μ. The resultant film was uniform, free of pinholes and had a thickness of 190 The film was highly smooth-surfaced.

EXAMPLE 3

Coating was conducted in the same manner as in Example 1, except that the flow rate of the air stream was 18 m/sec.

The resultant film was uniform, free of pinholes and had a thikness of 220 μ. The film was found to be smooth-surfaced.

For comparison coating in Example 1 was carried out at flow rate of 1 m/sec and 22 m/sec. In the former case dry powder was deposited only on the front part of the pipe with almost no deposition on the back part, failing to produce uniform film, and in the latter case almost no deposition of the dry powder was observed.

EXAMPLE 4

The inner surfaces of the steel pipes having different inner diameters were coated in the same manner as in Example 1, with the results shown in Table 1 below, in which the surface conditions of the resultant film were inspected in the same manner as in Example 1.

Table 1

| No. | Inner dia. of pipe (mm) | Thickness of film (μ) | Surface conditions of film | |
|---|---|---|---|---|
| 1 | 12.7 | 180 | Uniform and free of pinhole | Excellent in surface-smoothness |
| 2 | 35.7 | 220 | " | " |
| 3 | 105.3 | 300 | " | " |

EXAMPLE 5

The powder coating composition deposited on pipes in the same manner as in Example 1 was heated and fused to form a continuous coating film by following the same procedure as in Example 1 except that the fusing of the deposited particles was conducted at varying reduced pressures. The results are given in Table 2 below.

Table 2

| No. | Reduced pressure in fusing (mm Hg) | Thickness of film (μ) | Surface conditions of film | |
|---|---|---|---|---|
| | | | Pinhole | Surface-smoothness |
| 1 | 5 | 180 | Free | Poor |
| 2 | 30 | 220 | " | Excellent |
| 3 | 80 | 250 | " | " |
| 4 | 100 | 270 | " | Good |
| 5 | 120 | 280 | Found | Poor |
| 6 | 760 | 260 | " | Poor |

EXAMPLE 6

A steel pipe, 5.5 m in length and 40 mm in inner diameter, was coated using the following powder coating composition:

| | |
|---|---|
| Powder coating composition used: | |
| Components | |
| Polyamide (Nylon 12): | 100 wt. parts |
| Dioctyl phthalate (plasticizer): | 5 wt. parts |
| Titanium dioxide (pigment): | 10 wt. parts |
| Softening point: | 140°C |
| Melting point: | 180°C |
| Particle size: | 30–200 μ |

The pipe mounted on the rotating means 1 was rotated at 30 r.p.m. and heated at a temperature of about 160°C. The above powder coating composition was blown through the flock spray-gun to the baffle 14 at the rate of 350 g/min. At the same time air was sucked by means of suction pump, whereby air stream flowing through the interior of the pipe at a flow rate of 10 m/sec. was produced. The dry powder blown was carried by air stream and deposited on the inner surface of the pipe. The procedure was continued for 3 minutes.

Subsequently, the steel pipe A with the coating composition deposited on its inner surface was tightly closed at its one end by a silicon rubber cork and connected at the other end thereof to the suction pump by way of manometer. While maintaining the interior of the steel pipe A at a reduced pressure of 30 mm Hg, the pipe A was heated in an oven at a temperature of 200°C for 30 minutes, and then the interior pressure of the hollow steel pipe A was returned to the atmospheric pressure. As a result the hollow steel pipe was obtained which was on its inner surface coated with the film of polyamide having an almost uniform thickness of about 200 – 280 $\mu$.

EXAMPLE 7

Coating was conducted in the same manner as in Example 6, except that the flow rate of the air stream was varied as shown in Table 3 below, in which the results are also given.

Table 3

| No. | Flow rate (m/sec.) | Thickness of film ($\mu$) | Surface condition of film | |
|---|---|---|---|---|
| | | | Pinhole | Surface-smoothness |
| 1 | 2 | 130 – 560 | Free | Poor |
| 2 | 4 | 190 – 350 | " | Good |
| 3 | 15 | 250 – 370 | " | Excellent |
| 4 | 20 | 150 – 260 | " | Good |
| 5 | 25 | 0 – 130 | Found | Poor |

EXAMPLE 8

The inner surface of the steel pipes having different inner diameters were coated in the same manner as in Example 6, with the results shown in Table 4 below.

Table 4

| No. | Inner dia. of pipe (mm) | Average thickness of film ($\mu$) | Surface conditions of film | |
|---|---|---|---|---|
| | | | Pinhole | Surface-smoothness |
| 1 | 16.1 | 290 | Free | Excellent |
| 2 | 52.9 | 300 | " | " |
| 3 | 105.3 | 270 | " | " |

EXAMPLE 9

Various metal pipes made of copper, stainless-steel and aluminum, respectively 5.5 m in length and 35.7 mm in inner diameter, were coated in the same manner as in Example 6, with the results shown in Table 5 below.

Table 5

| No. | Pipe | Average thickness of film ($\mu$) | Surface conditions of film | |
|---|---|---|---|---|
| | | | Pinhole | Surface-smoothness |
| 1 | Copper | 320 | Free | Excellent |
| 2 | Stainless-steel | 370 | " | " |
| 3 | Aluminum | 260 | " | " |

EXAMPLE 10

The inner surface of a steel pipe, 5.5 m in length and 35.7 mm in inner diameter was coated in the same manner as in Example 6 with various dry coating compositions of a particle size of about 20 to 200 $\mu$shown in Table 6 below, in which the results are also shown.

Table 6

| No. | Coating Comp. | Average thickness of film ($\mu$) | Surface conditions of film | |
|---|---|---|---|---|
| | | | Pinhole | Surface-smoothness |
| 1 | Polyvinyl chloride | 280 | Free | Excellent |
| 2 | Polyethylene | 330 | " | " |
| 3 | Polyester | 350 | " | " |
| 4 | Phenol resin | 300 | " | " |
| 5 | Chlorinated polyester | 300 | " | " |
| 6 | Fluorine resin | 280 | " | " |

What we claim is:

1. A method for coating the inner surface of a metal pipe having an inner diameter of about 1 to 15 cm, which consists essentially of feeding from one end of said metal pipe dry particles of a coating composition into the interior of the metal pipe preheated at a temperature of from a softening point of said coating composition to below a melting point thereof, sucking air at the same time from the other end of the metal pipe so as to form an air stream carrying the particles and flowing in the interior of the pipe at a flow rate of about 4 to 20 m/sec and to allow the particles to deposit on the inner surface of the pipe, and fusing the deposited particles at a reduced pressure of 30 to about 100 mm Hg to form a continuous film on the inner surface of the pipe.

2. The method for coating the inner surface of a metal pipe according to claim 1, in which said flow rate of air stream is in the range of 3 to 13 m/sec.

3. The method for coating the inner surface of a metal pipe according to claim 1, in which said metal pipe is rotated at the rate of at least one r.p.m.

4. The method for coating the inner surface of a metal pipe according to claim 3, in which said pipe is rotated at the rate of 5 to 50 r.p.m.

5. The method for coating the inner surface of a metal pipe according to claim 1 in which the dry particles are fed into the pipe by a flock spray gun.

6. A method according to claim 1 wherein the reduced pressure is from 30 to 80 mm Hg.

* * * * *